US006945156B2

(12) United States Patent
Schnedl et al.

(10) Patent No.: US 6,945,156 B2
(45) Date of Patent: Sep. 20, 2005

(54) DEVICE FOR SWITCHING AND LOCKING MOVING POINTS COMPONENTS

(75) Inventors: Karl Schnedl, Grosslobming (AT); Herbert Achleitner, Graz (AT)

(73) Assignees: VAE Eisenbahnsyteme GmbH, Zeltweg (AT); VAE GmbH, Vienna (AT)

( * ) Notice: Subject to any disclaimer, the term of this patent is extended or adjusted under 35 U.S.C. 154(b) by 0 days.

(21) Appl. No.: 10/250,834

(22) PCT Filed: Jan. 11, 2002

(86) PCT No.: PCT/AT02/00007

§ 371 (c)(1),
(2), (4) Date: Jul. 3, 2003

(87) PCT Pub. No.: WO02/055360

PCT Pub. Date: Jul. 18, 2002

(65) Prior Publication Data

US 2004/0065193 A1 Apr. 8, 2004

(30) Foreign Application Priority Data

Jan. 11, 2001 (AT) ..... A 40/2001

(51) Int. Cl.[7] ..... F15B 15/26; F15B 15/28

(52) U.S. Cl. ..... 92/5 R; 92/23; 92/25; 92/27; 91/41

(58) Field of Search ..... 92/23, 25, 27, 92/5 R; 91/41, 44, 45

(56) References Cited

U.S. PATENT DOCUMENTS

| | | | | | |
|---|---|---|---|---|---|
| 4,586,425 | A | * | 5/1986 | Redman et al. | 91/45 |
| 4,647,089 | A | * | 3/1987 | Zangrando | 292/144 |
| 4,703,683 | A | * | 11/1987 | Sue | 92/27 |
| 4,742,758 | A | * | 5/1988 | Della Rocca | 92/27 |
| 4,754,694 | A | * | 7/1988 | Martin | 92/5 L |
| 4,951,552 | A | * | 8/1990 | Fox | 92/27 |
| 5,603,536 | A | * | 2/1997 | Bauer et al. | 292/144 |
| 6,322,276 | B1 | * | 11/2001 | Liu | 403/31 |

FOREIGN PATENT DOCUMENTS

| | | | |
|---|---|---|---|
| AT | 403 463 | 2/1998 | B61L/5/10 |
| EP | 0 592 755 | 4/1994 | B61L/5/04 |
| WO | WO 98/54041 | 12/1998 | B61L/5/10 |

* cited by examiner

*Primary Examiner*—Edward K. Look
*Assistant Examiner*—Igor Kershteyn
(74) *Attorney, Agent, or Firm*—Chapman and Cutler LLP

(57) ABSTRACT

The invention relates to a device for displacing and locking movable switch parts (1), comprising a hydraulic piston, which is formed by a rod (6) and cooperates, via coupling or locking members (8), with an axially displaceable sleeve (5) intended to receive the radially displaceable coupling or locking members (8), The displaceable sleeve (5) is coupled with the movable switch parts (1) and an externally arranged tube (4), at least partly overlapping the sleeve (5) and the rod (6). A hydraulic duct (11) is connected to the externally arranged tube (4), on a front face of the sleeve (5), facing away from the coupling site for the movable switch parts (1).

18 Claims, 3 Drawing Sheets

DEVICE FOR SWITCHING AND LOCKING MOVING POINTS COMPONENTS

The invention relates to a device for displacing and locking movable switch parts, including a hydraulic piston which is formed by a rod and cooperates, via coupling or locking members, with an axially displaceable sleeve intended to receive the radially displaceable coupling or locking members, the displaceable sleeve being coupled with the movable switch part, and an externally arranged tube at least partially overlapping the sleeve and the rod.

BACKGROUND OF THE INVENTION

Devices for locking the end positions of movable switch parts are known in various configurations. EP 0 603 156 A1 shows and describes an end position securing means for movable switch parts and, in particular, a switch lock in which a pin or rod is guided within a tube, with the rod and the tube being held within an outer tube in an axially displaceable manner. The tube has openings for locking members which are capable of being shifted in the radial direction and, in the known embodiment, are formed by balls or rolls. The rod jacket likewise comprises appropriate recesses at predetermined axial distances so as to enable the locking members, by displacing the rod relative to the tube carrying the locking members, to be displaced either into an external locking position in which they cooperate with stops provided in the outer tube or inwardly so as to render feasible the relative displacement of the tube and the rod in the axial direction. In those known configurations, the tube carrying the locking members was coupled with the switch parts to be adjusted. WO 98/54041, in a modified configuration, proposed a locking device with a hydraulic unit coupled thereto, in which the locking device itself, however, did not form part of the hydraulic actuating means and was guided in a separate, sealed housing. In order to effect also a displacement of the movable switch parts when displacing the rod, the sleeve or rod carrying the locking members must accordingly be entrained by the rod over a predetermined axial displacement path with the displacement forces having to be taken up by the coupling or locking members formed by balls for displacing the sleeve. In order to improve the locking effect, it has already been proposed to mount ring segments on the balls in a manner that the forces in the locking position will no longer be taken up as line-point contacts of the ball, but as forces acting on the annular surfaces of the locking segments. In the locking position, it was thereby safeguarded that the large locking forces in the order of 100,000 Newton could be safely taken up on the respective annular surfaces.

In addition to those configurations, different embodiments of switching aids can be taken from AT 403 683 B and AT 406 038 B, in which an accordingly resiliently designed support of the displacement movement was rendered feasible over a partial region of the displacement path. To this end, either the locking members or the sleeve carrying the locking members were supported via springs in a manner that the sleeve could be displaced over a portion of the displacement path under the support of the spring force as a function of the position of the respective coupling or locking members. The internally arranged rod in such embodiments is connected with appropriate coupling members for the movable switch parts.

SUMMARY OF THE INVENTION

The invention now aims to provide a device for adjusting and locking movable switch parts of the initially defined kind, which has a particularly compact structure and guarantees an enhanced wear-resistance. Departing from the known principle, according to which two relatively movable parts, namely at least one tube and a rod, are guided within a stationary tube and the movable switch parts are coupled with the tube, the invention aims to integrate all elements within the outer tube while additionally enabling continuous lubrication of the parts subjected to wear. Furthermore, the coupling members and, in particular, coupling members formed by balls are to be effectively secured against overload.

To solve this object, the invention essentially consists in that a hydraulic duct runs into the externally arranged tube on a sleeve end face that faces away from the coupling site for the movable switch part. Due to the fact that a hydraulic duct runs into the externally arranged tube on a sleeve end face that faces away from the coupling site for the movable switch part, the externally arranged tube can be completely secured as the cylinder of a hydraulic actuator, thus enabling fluid to be fed both to the internally located rod and to the sleeve surrounding the rod and carrying the coupling members and the locking members. In this manner, pressure is accordingly supplied not only to the end face of the rod but also to the annular surface of the sleeve, whereby only a small portion of the switching force will enter into effect via the end face of the internally located rod and a comparatively substantially higher portion of the displacement force will enter into effect directly via the end face of the internally located tube. Thus, in order to entrain the tube for the purpose of adjusting the movable switch part, forces transmitted from the internally located rod to the tube via the coupling members or balls will no longer exclusively enter into effect, but additional forces will be directly introduced into the tube such that the balls or coupling or locking members will be accordingly relieved. In this manner, the risk of overload and premature wear is substantially reduced, wherein, if, for instance, hydraulic liquid or oil is used as a fluid medium, all parts will be directly conducted in an oil bath so as to enable a substantial reduction of mechanical wear. In the main, it is feasible by this arrangement to substantially relieve the coupling or locking members and ensure a particularly high degree of operating safety.

Basically, one or several locking planes may be provided in every switching unit. For the switching device of a movable frog, such units may be directly connected with one another with the displaceable inner tubes being connected to an appropriate coupling unit. In the main, it is thereby feasible to realize a very rigid switching device poor in vibrations.

In a preferred manner, the configuration according to the invention is devised such that the sleeve is sealingly guided in the externally located tube so that oil leakages will be largely avoided.

As already known per se from other designs, the configuration is preferably devised such that the coupling or locking members are comprised of balls which cooperate with locking members formed by annular segments. During the switching procedure, the balls are appropriately relieved as mentioned in the beginning, thus ensuring the respective surface contact in the locking position as can be provided by ring segments reaching into respective recesses of the outer tube.

Basically, it is desirable with such devices to integrate suitable control or switching elements in the adjusting and locking mechanism so as to enable the safe monitoring of the respective end position. Such a switching or monitoring element can preferably be installed in the bottom of the cylinder volume, wherein it has to be taken into account in the configuration according to the invention that a pressure medium is fed to this bottom of the cylinder volumes in which both the rod and the sleeve are displaceable as a piston. In conventional actuators an accordingly high operating pressure may, thus, principally cause a displacement of the actuator already in the bottom of the cylinder, whereby indication errors cannot be excluded. Basically, a spring acting against the direction of displacement of the actuator of the switch or switching valve can naturally be dimensioned sufficiently strong to withstand the fluid pressure within the working volume. In such cases, the actuation of the switch or switching valve in the end position would, however, require high forces. According to a preferred further development of the device according to the invention, the configuration is therefore devised such that a tappet is mounted in an axially displaceable manner in the bottom of the working cylinder carrying the hydraulic connection, of the rod and sleeve, said tappet being preferably designed as a step piston. When designing the tappet as a step piston, displacement movements of the tappet will be prevented with the fluid in the working volume being under pressure, and the adjustment forces required for the safe indication of the end position will be accordingly reduced. In this case, the configuration advantageously is devised such that the tappet cooperates with an electric switch and/or a switching valve.

BRIEF DESCRIPTION OF THE SEVERAL VIEWS OF THE DRAWINGS

In the following, the invention will be explained in more detail by way of an exemplary embodiment schematically illustrated in the drawing. Therein.

DETAILED DESCRIPTION OF THE INVENTION

Figure 1:
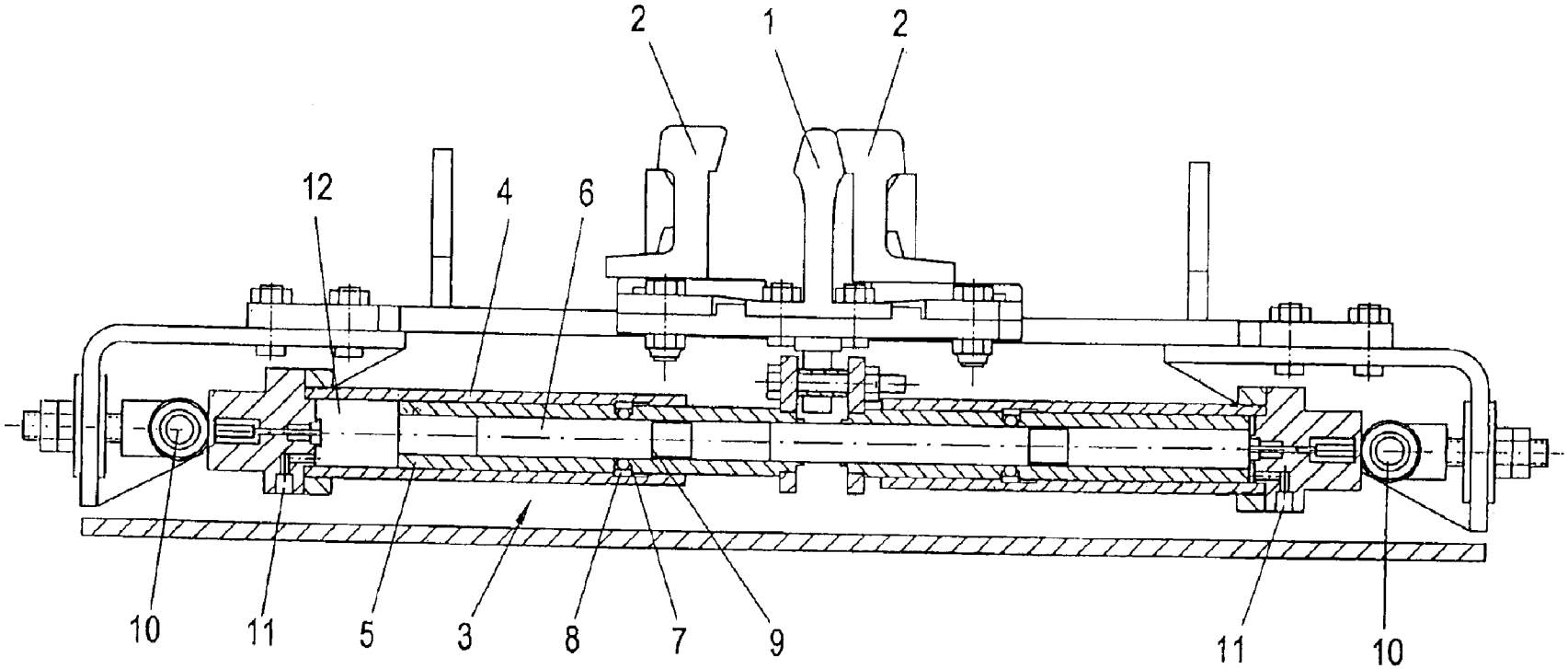
FIG. 1 illustrates a cross section through a device according to the invention, the device in this case being designed for the adjustment of a movable frog.

FIG. 1 depicts a movable frog 1, which is to be facultatively displaced into abutment on two guardrails 2 and locked in the respective abutment position. The device for adjusting the position of the frog 1 and locking the respective end position is denoted by 3 and comprises an outer tube 4, an inner tube 5 guided within said outer tube, and a rod 6. The internally arranged tube 5 includes openings 7 for the reception of locking or coupling members 8, the inwardly located rod 6 having an appropriate stop shoulder 9 for coupling with said coupling and locking members 8. The device 3 is stationarily fixed to the ends schematically indicated by 10. In addition, a hydraulic connection 11 running into a working volume 12 is apparent, the respective connections being symmetrically provided in the representation according to FIG. 1.

In the illustration according to FIG. 1, the frog 1 is displaced in its right-side end position, wherein the locking members 8 engage in respective locking grooves of the outwardly arranged tube 4 by running onto the respective full cross section of the rod 6, thus causing the internally arranged tube 5 to be secured against further displacement and the frog 1 to be safely held in the abutment position. This corresponds to the position illustrated in FIG. 2 on an enlarged scale, from which it is also apparent that the coupling and locking members are formed by internally arranged balls 13 and ring segments 14 overlapping the balls so as to enable the surface contact of the ring segments with the flank of the groove 15 in the locking position. The pressure medium supplied in the working volume 12 via the connections 11 during the displacement movement in the sense of arrow 16 powers not only the end face 17 of the rod 6, but also the end face 18 of the internally arranged tube 5, which is designed as an annular surface.

Figure 2:
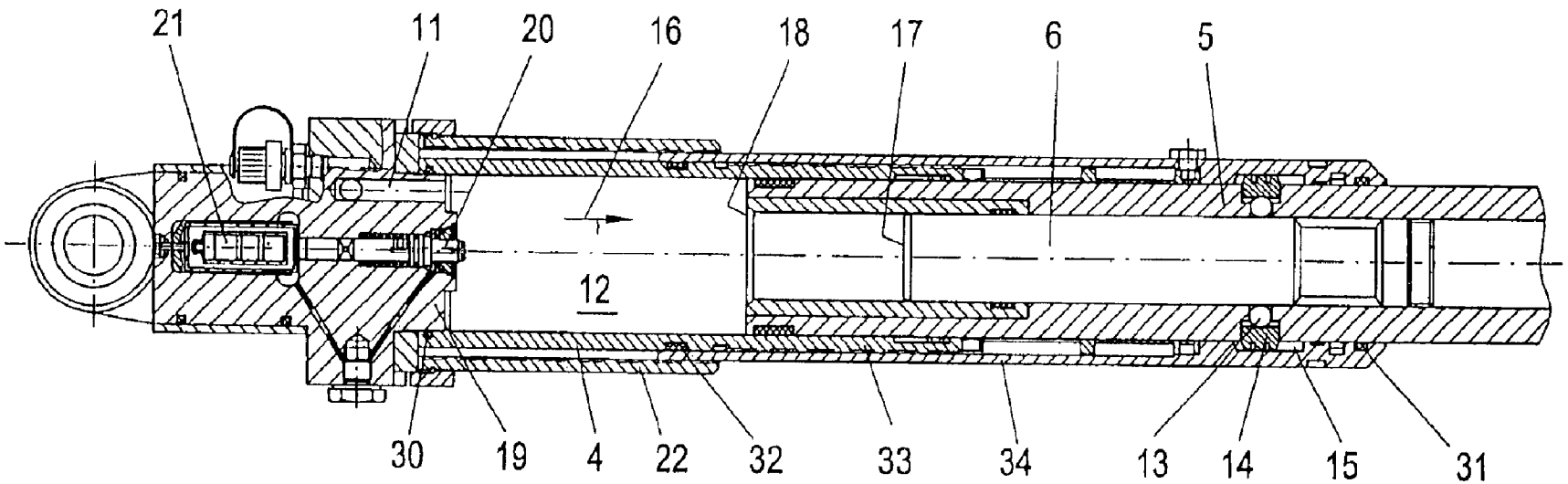
FIG. 2 is an enlarged sectional illustration of one half of the device according to FIG. 1.
Figure 3:
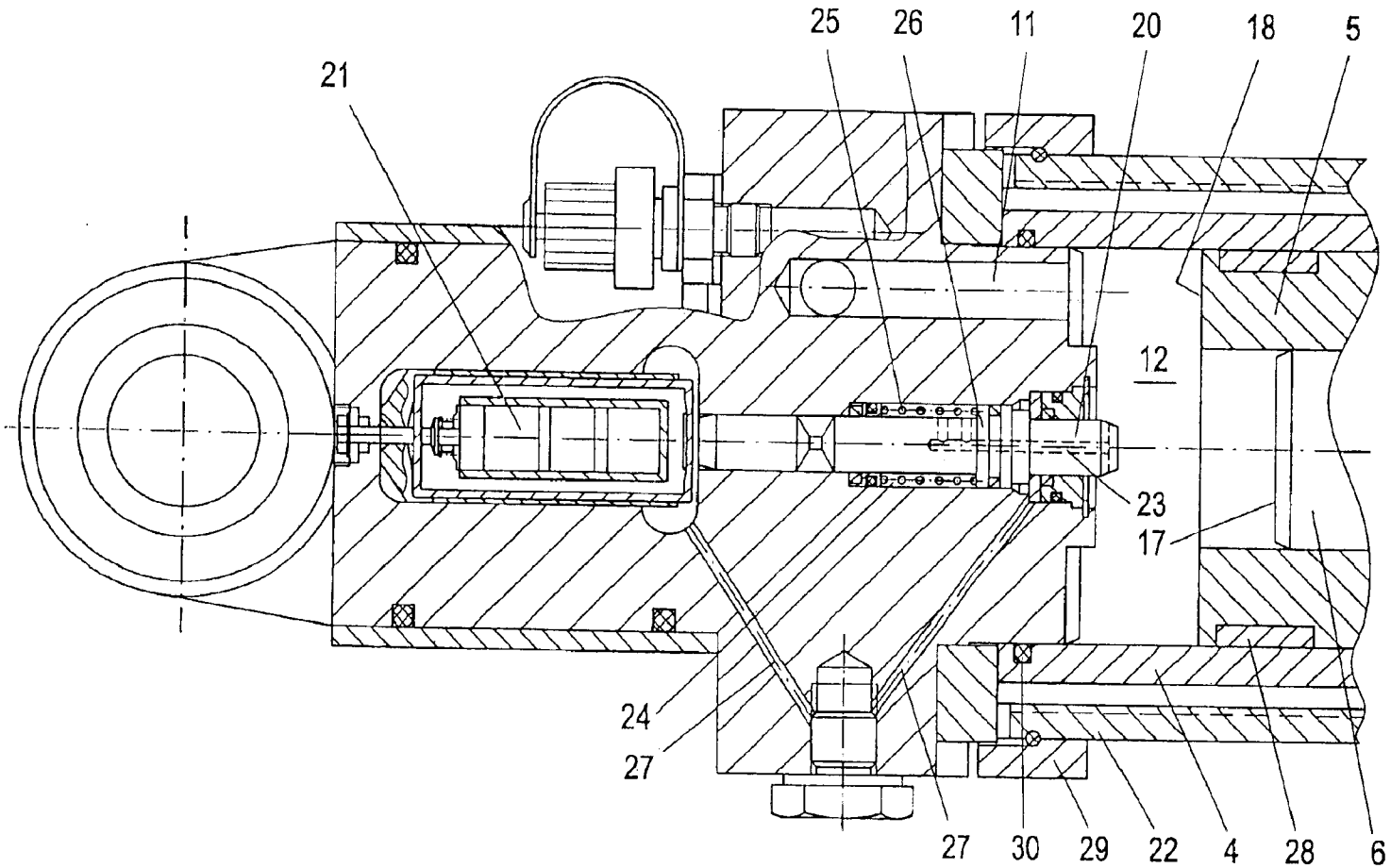
FIG. 3 depicts an enlarged detail of the valve arrangement in the bottom of the working cylinder.

In the bottom of the cylinder, which is connected with the externally arranged tube 4 and denoted by 19, a tappet 20 functioning as an actuator for an electric switch 21 and/or a switch valve is provided. The outer tube 4 is sealingly connected with said bottom 19, wherein, in the enlarged representation of FIG. 2, a further flange tube 22 is additionally provided over a partial region of the axial length of the outer tube 4, which further flange tube may be equipped with appropriate screw connections in order to ensure the safe anchorage and tight connection of the externally arranged tube 4 to the bottom 19. In FIG. 3, the actuator or tappet 20 is illustrated on an enlarged scale, and it is apparent that an axial bore 23 interconnects the working volume 12 with the spring volume 24 of the tappet 20. The tappet itself is supported by means of a spring 25 and includes a piston 26 whose spring-volume-side annular surface is accordingly powered by the fluid entering the spring volume 24 through the working volume 12 and the axial bore 23, so that the tappet 20 will remain in its extended position even if the pressure within the working volume 12 rises accordingly. The tappet 20 again cooperates with the switch 21, suitable aeration holes being denoted by 27.

The internally arranged tube 5 is slidingly guided in the outer tube 4 with guiding elements 28 being interposed, whereby the outer tube is braced against the bottom 19 of the working volume 12 by the flange tube 22 additionally screwed with the same, and the flange 29.

The outer tube 4 is sealed relative to the bottom 19 by a seal 30 and, furthermore, at the exit of the sleeve by a seal 31. With a divided outer tube 4 as illustrated in FIG. 2, a further seal 32 is provided between the internal outer tube 33 and the external outer tube 34. The locking members 13 and 14 as well as the adjustable cheek bridges can, thus, be conducted in an oil bath so as to substantially reduce abrasive and frictional forces.

We claim:

1. A device for displacing and locking movable switch parts (1), comprising a hydraulic piston which is formed by a rod (6), said rod cooperating by way of radially displaceable locking members (8), with an axially displaceable sleeve (5) adapted to receive the locking members (8), said displaceable sleeve (5) being coupled with the movable switch part (1), and a working cylinder for the rod (6) and the sleeve (5), said working cylinder being formed by an externally arranged tube (4) at least partially overlapping the sleeve (5) and the rod (6), wherein a bottom (19) of said working cylinder carries a hydraulic connection (11) running into the working cylinder on a sleeve end face that faces away from a coupling site for the movable switch part (1), and wherein a tappet (20) is mounted in an axially displaceable manner in said bottom (19), said tappet (20) capable of being displaced by an end face of said piston when said piston moves towards said bottom (19).

2. A device according to claim 1, wherein the sleeve (5) is sealingly guided in the externally located tube (4).

3. A device according to claim 2, wherein the locking members (8) are balls (13) which cooperate with annular segments (14).

4. A device according to claim 3, wherein the tappet (20) is designed as a step piston.

5. A device according to claim 3, wherein the tappet (20) cooperates with an electric switch (21).

6. A device according to claim 3, wherein the tappet (20) cooperates with a switching valve.

7. A device according to claim 2, wherein the tappet (20) is designed as a step piston.

8. A device according to claim 2, wherein the tappet (20) cooperates with an electric switch (21).

9. A device according to claim 2, wherein the tappet (20) cooperates with a switching valve.

10. A device according to claim 1, wherein the locking members (8) are balls (13) which cooperate with annular segments (14).

11. A device according to claim 10, wherein the tappet (20) is designed as a step piston.

12. A device according to claim 10, wherein the tappet (20) cooperates with an electric switch (21).

13. A device according to claim 10, wherein the tappet (20) cooperates with a switching valve.

14. A device according to claim 1, wherein the tappet (20) is designed as a step piston.

15. A device according to claim 14, wherein the tappet (20) cooperates with an electric switch (21).

16. A device according to claim 14, wherein the tappet (20) cooperates with a switching valve.

17. A device according to claim 1, wherein the tappet (20) cooperates with an electric switch (21).

18. A device according to claim 1, wherein the tappet (20) cooperates with a switching valve.

* * * * *